US011708194B2

(12) United States Patent
Miksovsky

(10) Patent No.: US 11,708,194 B2
(45) Date of Patent: Jul. 25, 2023

(54) SEALABLE POUCH

(71) Applicant: humangear, Inc., San Francisco, CA (US)

(72) Inventor: Christopher A. Miksovsky, Bend, OR (US)

(73) Assignee: humangear, Inc., San Francisco, CA (US)

( * ) Notice: Subject to any disclaimer, the term of this patent is extended or adjusted under 35 U.S.C. 154(b) by 0 days.

(21) Appl. No.: 17/675,918

(22) Filed: Feb. 18, 2022

(65) Prior Publication Data

US 2022/0289432 A1 Sep. 15, 2022

Related U.S. Application Data

(60) Provisional application No. 63/158,502, filed on Mar. 9, 2021.

(51) Int. Cl.
*B65D 33/25* (2006.01)

(52) U.S. Cl.
CPC ..... *B65D 33/2508* (2013.01)

(58) Field of Classification Search
CPC ..... B65D 33/2508; B65D 33/1658; B65D 33/1666; B65D 33/1675
USPC ..... 383/63, 64, 68, 69
See application file for complete search history.

(56) References Cited

U.S. PATENT DOCUMENTS

| | | | | |
|---|---|---|---|---|
| 2,142,764 | A * | 1/1939 | Kluger | A45C 13/06 383/34 |
| 2,544,929 | A * | 3/1951 | Madsen | A61F 7/086 383/7 |
| 2011/0038564 | A1* | 2/2011 | Slansky | B65D 33/004 383/106 |
| 2013/0322788 | A1 | 12/2013 | Ackerman et al. | |
| 2016/0236826 | A1* | 8/2016 | Hoskins | B65D 33/1675 |
| 2022/0024642 | A1* | 1/2022 | Han | A47J 47/02 |

FOREIGN PATENT DOCUMENTS

| | | | |
|---|---|---|---|
| CN | 206345186 | | 7/2017 |
| CN | 211033580 | | 7/2020 |
| JP | 2003-072779 | | 3/2003 |
| KR | 20160131865 | A * | 11/2016 |
| KR | 10-2018-0017528 | | 2/2018 |
| KR | 20180017528 | A * | 2/2018 |

OTHER PUBLICATIONS

Machine translation of KR-20180017528-A.*
Machine translation of KR-20160131865-A.*
International Search Report and Written Opinion dated May 31, 2022 from International Application No. PCT/US2022/017071.
(Continued)

*Primary Examiner* — Jes F Pascua
(74) *Attorney, Agent, or Firm* — Beyer Law Group LLP

(57) ABSTRACT

Sealable pouch assemblies are described. In some embodiments, the sealable pouch assembly includes a soft pouch formed from an elastomeric material. The pouch includes a plurality of spaced apart external protrusions located near a top end of the pouch. A semi-rigid external frame is attachable to the pouch by the protrusions. The frame has a stable closed state and a stable open state. A slider is configured to slide over the external frame with the external frame in the closed state to seal the pouch in a closed pouch state.

23 Claims, 13 Drawing Sheets

(56) References Cited

OTHER PUBLICATIONS

Stasher, "Reusable Silicon Bags" https://www.stasherbag.com. Downloaded Feb. 18, 2022.
Zip Top, "100% Platinum Silicone Reusable Containers with NO Lids!" https://ziptop.com/. Downloaded Feb. 17, 2022.
(RE) Zip, "Leakproof Reusable Stoage", https://rezip.com. Downloaded Feb. 17, 2022.
FFresh 5x Reusable Freezer Bags, Heavy Duty 30oz. Silicone Food Storage Bags https://www.amazon.com/gp/product/B07DK41XBT/ref=ppx_yo_dt_b_search_a_sin_title?ie=UTF8&psc=1. Downloaded Feb. 17, 2022.
Humangear GoTote Travel Tote—Travel Bag, https://www.amazon.com/humangear-HG0602-GoTote-Travel-Tote/dp/B00TSV933C. Downloaded Feb. 17, 2022.
Kerns, Nancy, "The Best Dog Treat Bags You Can Buy", https://www.whole-dog-journal.com/lifestyle/the-best-dog-treat-bags-you-can-buy/, Published Jul. 13, 2016. Downloaded Feb. 18, 2022.
Karen Pryor Clicker Training Black Treat Pouch by Terry Ryan, https://www.amazon.com/Karen-Pryor-Clicker-Training-Black/dp/B00CDSDDWY. Downloaded Feb. 17, 2022.
POC, "Crave Clarity Performance Sunglasses" https://na.pocsports.com/products/crave-clarity?variant=42274431336614. Downloaded Feb. 17, 2022.
Platypus, "Big Zip EVO", https://www.platy.com/reservoirs/big-zip-evo/big-zip-evo.html. Downloaded Feb. 17, 2022.
3 Pack—Bag Clips—Extra Large Bag Sealing Clips ideal for large snack bags, https://www.amazon.com/gp/product/B07Z9PJDCW/ref=ppx_yo_dt_b_search_a_sin_title?ie=UTF8&psc=1. Downloaded Feb. 17, 2022.

* cited by examiner

SEALABLE POUCH

CROSS-REFERENCE TO RELATED APPLICATIONS

The present application claims the priority of U.S. Provisional Patent Application No. 63/158,502 filed Mar. 9, 2021, which is incorporated herein by reference in its entirety.

FIELD

The present disclosure relates generally to sealable bags and pouches.

BACKGROUND

Reusable sealable bags and pouches come in a variety of different forms and many uses. One popular pouch structure uses a resealable zipper closure structure (e.g., Ziploc closures). Although such bags have many uses, they have a number of drawbacks. For example, the zipper closures can be difficult to seal completely and it is common for users to fail to form a complete seal which leaves the bag susceptible to leakage. These zipper closures also feature a number of crevices which can be difficult to clean and can permit the buildup of mold and mildew. Furthermore, most Ziplock style bags must be affirmatively held open to insert contents and don't stand on their own. Thus, they can be a difficult to fill. Although such bags and pouches work well for many applications, there are continuing efforts to develop bags and pouches that have desirable characteristics.

SUMMARY

To achieve the foregoing and other objects, a variety of sealable pouch assemblies are described. In some embodiments, the sealable pouch assembly includes a soft pouch formed from an elastomeric material. The pouch includes a plurality of spaced apart external protrusions located near a top end of the pouch. A semi-rigid external frame is attachable to the pouch by the protrusions. The frame has a stable closed state and a stable open state. A slider is configured to slide over the external frame with the external frame in the closed state to seal the pouch in a closed pouch state.

In some embodiments, the external frame includes a plurality of openings, each opening being configured to receive a corresponding pouch protrusion. In some embodiments, the protrusions each include overhangs configured to grip the external frame.

In some embodiments, the external frame includes a pair of rails and a pair of hinges. A first one of the hinges couples first ends of the rails together and a second one of the hinges couples second ends of the rails together. In some embodiments, each rail further includes a pair of intermediate flexures such that the open state of the external frame has a substantially hexagonal shape. In some implementations, each flexure may include one or more grooves or localized thin areas to create a flexible zone or "living hinge.".

In some embodiments, a knuckle on a first one of the rails includes a cam and the second rail has a feature that interferes with the knuckle to help provide the stable open and closed states. In some embodiments, each hinge includes a hinge pin, at least one first knuckle integrally formed with a first one of the rails and at least one second knuckle integrally formed with a second one of the rails.

In some embodiments, the external frame is a bi-stable external frame. In some implementations, the frame is formed from a material selected from the group consisting of: polypropylene; Nylon; acrylonitrile butadiene styrene (ABS); and polycarbonate.

In some embodiments, the frame is formed by injecting molding, and the pouch is formed of injection or compression molding. The frame and the pouch may be molded separate and then coupled using protrusions on the pouch and corresponding opening on the frame. In others, the frame may be molded directly onto the pouch.

In some embodiments, the pouch includes a gusset that facilitates standing the pouch upright. In some implementations, the pouch is formed from a material selected from the group consisting of: silicone; an elastomeric plastic; a thermoplastic rubber; or a thermoplastic elastomer.

In some embodiments, the protrusions are mushroom shaped bosses. In some implementations, the berms surround the openings to form stepped wells that receive the bosses.

In some embodiments, at least one of the rails includes a longitudinally extending pressure ridge on an inner surface of the rail that helps seal the pouch in the closed pouch state with the slider in place.

BRIEF DESCRIPTION OF THE DRAWINGS

The invention and the advantages thereof, may best be understood by reference to the following description taken in conjunction with the accompanying drawings in which.

In the drawings, like reference numerals are sometimes used to designate like structural elements. It should also be appreciated that the depictions in the figures are diagrammatic and not to scale.

DETAILED DESCRIPTION

Figure 1:
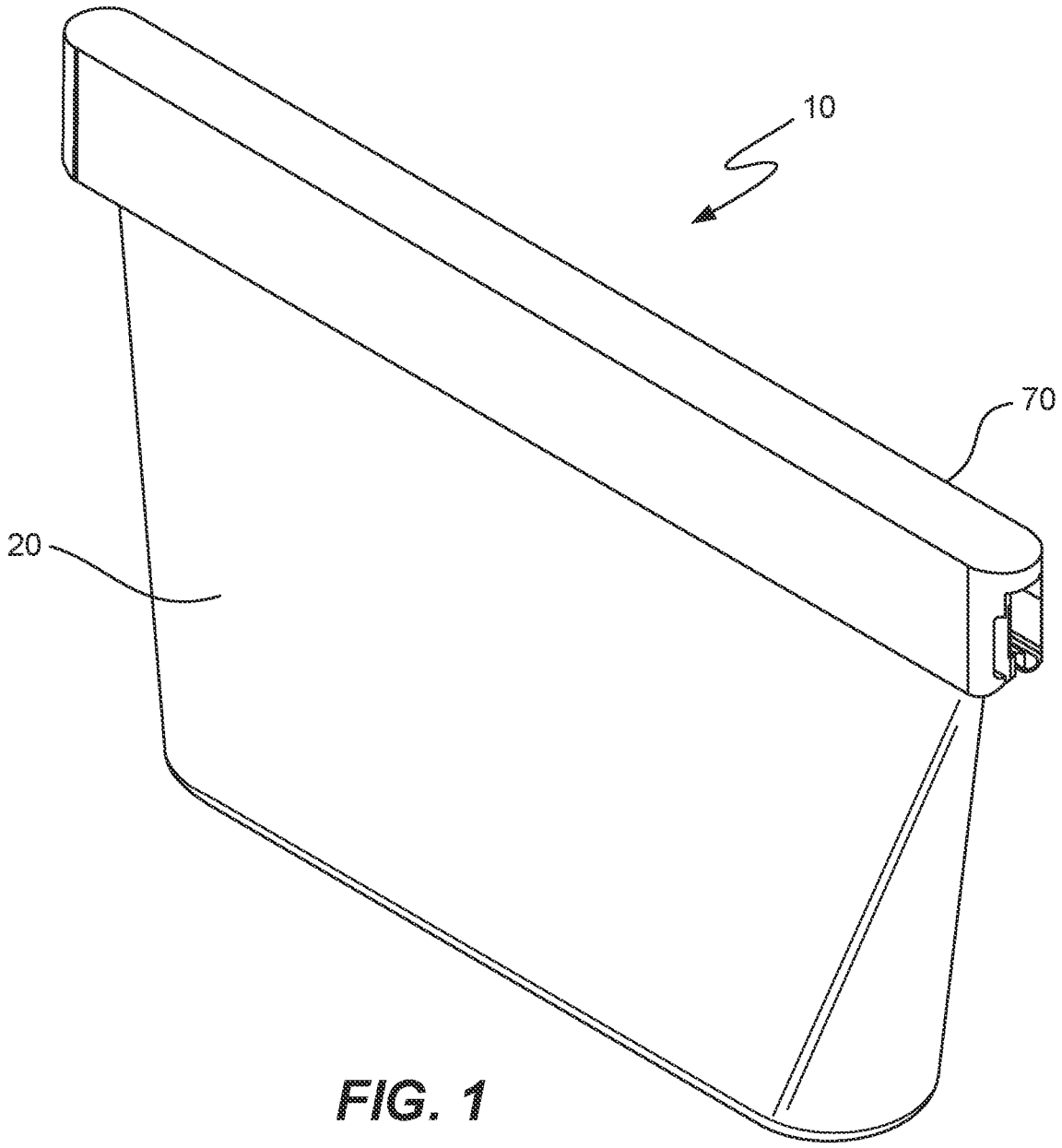
FIG. 1 is a perspective view of a sealable pouch assembly in accordance with a first embodiment.
Figure 2:
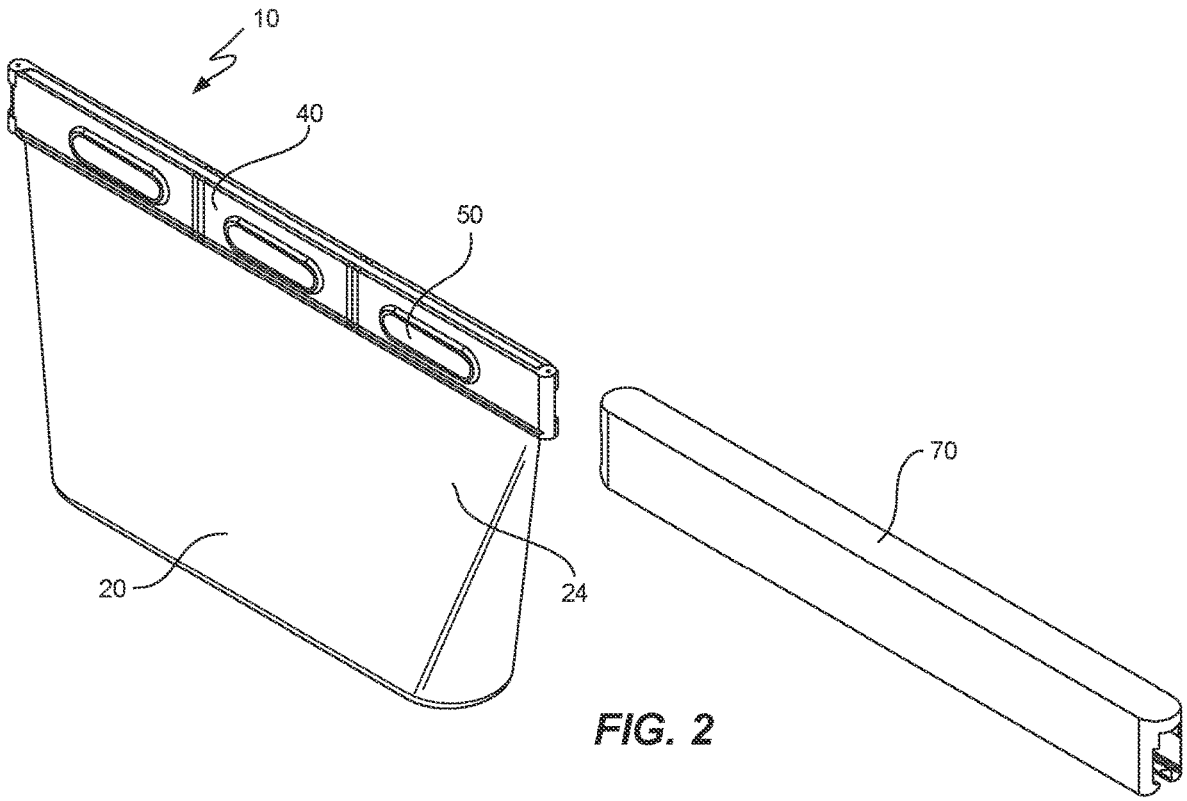
FIG. 2 is a perspective view of the sealable pouch assembly of FIG. 1 in the closed position with the slider removed.
Figure 3:
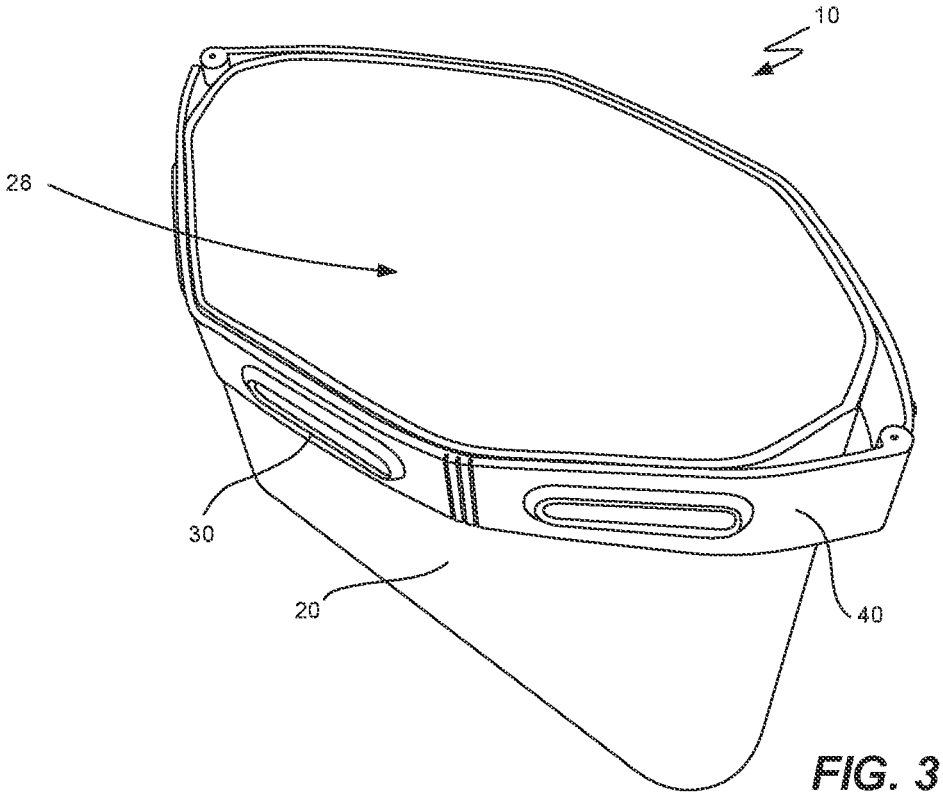
FIG. 3 is a perspective view of the sealable pouch assembly of FIG. 1 in the open position.
Figure 4:
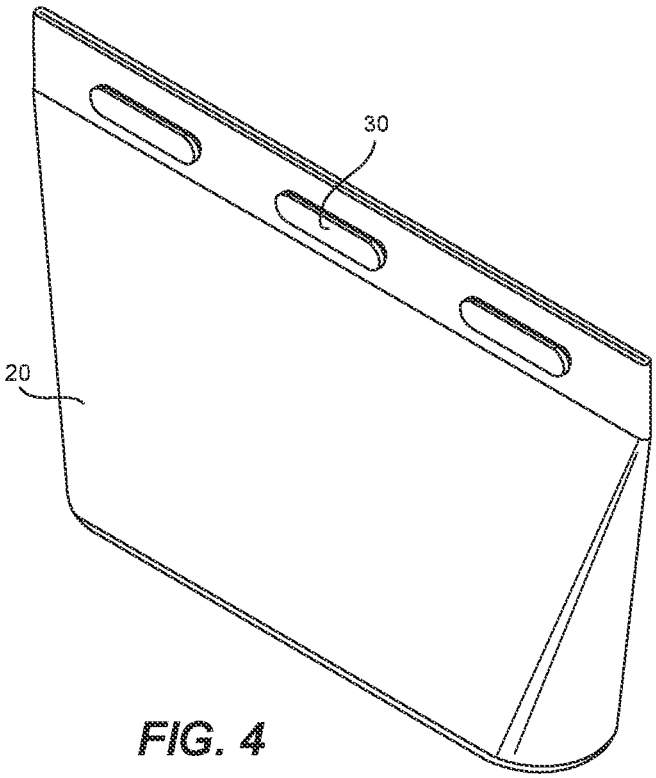
FIG. 4 is a perspective view of a soft pouch suitable for use in the sealable pouch assembly of FIG. 1.
Figure 5:
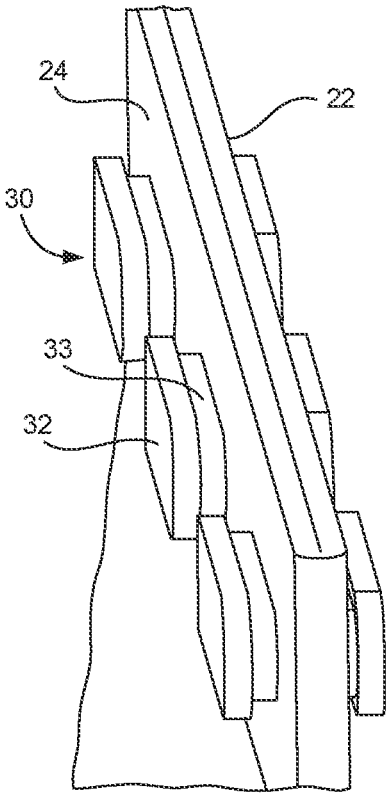
FIG. 5 is a perspective view of the soft pouch of FIG. 4 highlighting the attachment bosses.

FIGS. 1-10 illustrate a sealable pouch assembly 10 formed in accordance with a first embodiment. The sealable pouch assembly 10 includes a soft (elastomeric) pouch 20, an external frame 40 and a slider 70 as seen in FIGS. 1-3. The pouch 20 includes a pair of opposing panels 22, 24 that are joined together on opposite ends, a flat bottom 26, a top opening 28, and a plurality of external bosses 30 as best seen in FIGS. 4 and 5. The bosses 30 are provided on the external surface of the panels 22, 24 near the top edge of the panels. The pouch 20 may be formed from a variety of materials. By way of example, silicone or any of a variety of elastomeric plastics (soft plastics) or rubber materials such as thermoplastic rubbers (TPR) or thermoplastic elastomers (TPE) work well. The pouch 20 may be formed in a variety of different manners. For example, injection molding or compression molding the pouch 20 as a single piece works well.

The bosses 30 are preferably integrally molded with the panels 22, 24 and serve as attachment mechanisms for the external frame 40. In the illustrated embodiments the bosses are somewhat mushroom shaped in that they have a head portion 32 that has a larger footprint than a base portion 33 such that the head portion includes a lip portion 35 that overhangs the base portion 33 to provide a mechanism for grasping the frame 40.

The flat bottom portion 26 is sometimes referred to as a gusset in plastic bags and totes even though it is integrally formed with the rest of the bag. In some embodiments, the gusset 26 may be eliminated. However, an advantage of including the gusset is that it allows the pouch to stand on its own (a representative bottom portion/gusset can be seen in FIG. 11).

Figure 6:
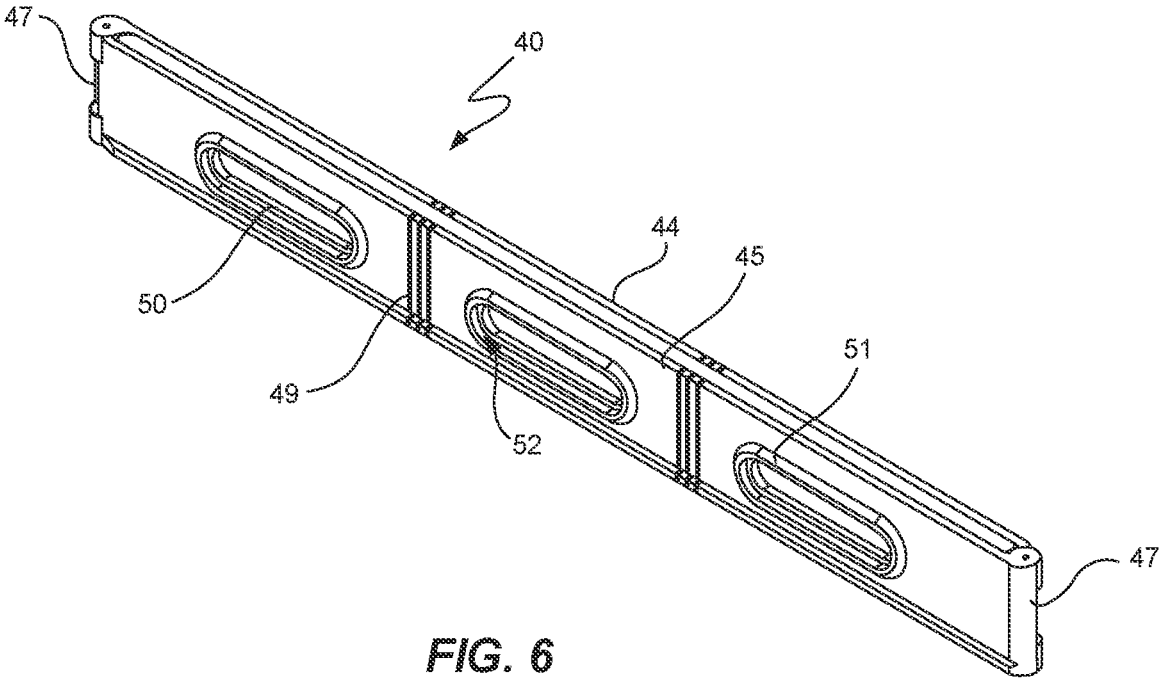
FIG. 6 is a perspective view of a frame suitable for use in the sealable pouch assembly of FIG. 1 in the closed position.
Figure 8:
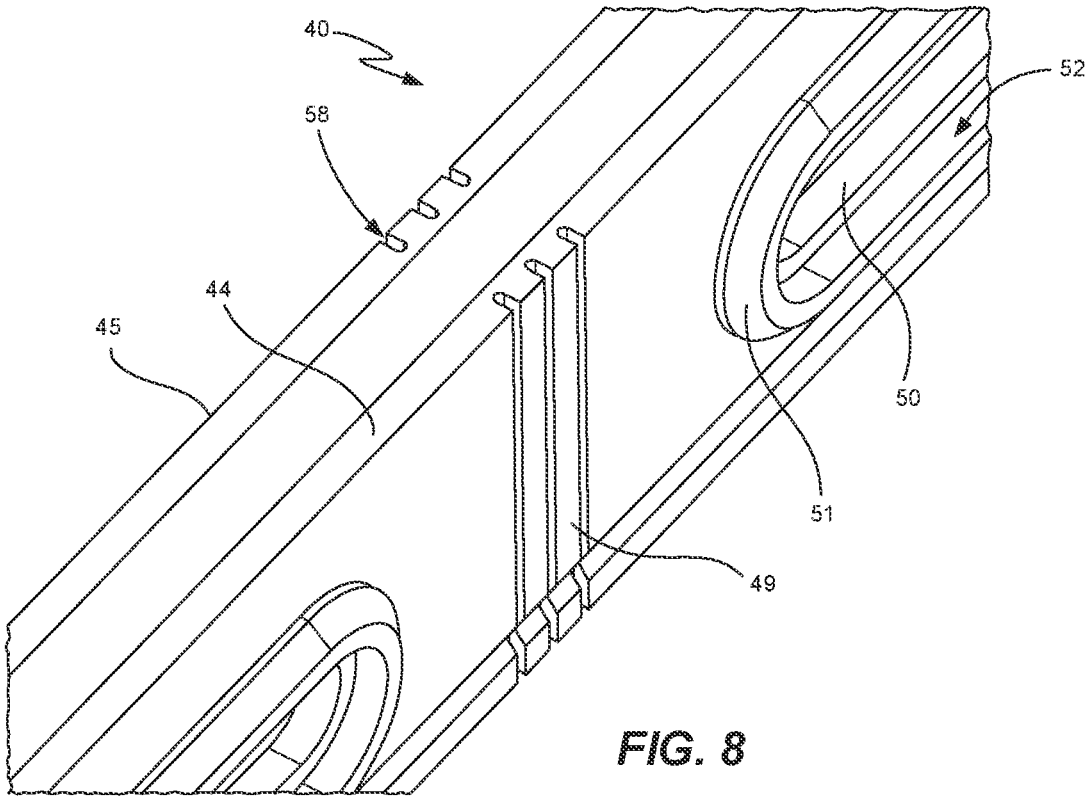
FIG. 8 is a perspective view highlighting an intermediate flexure region of the frame of FIG. 6.
Figure 10:
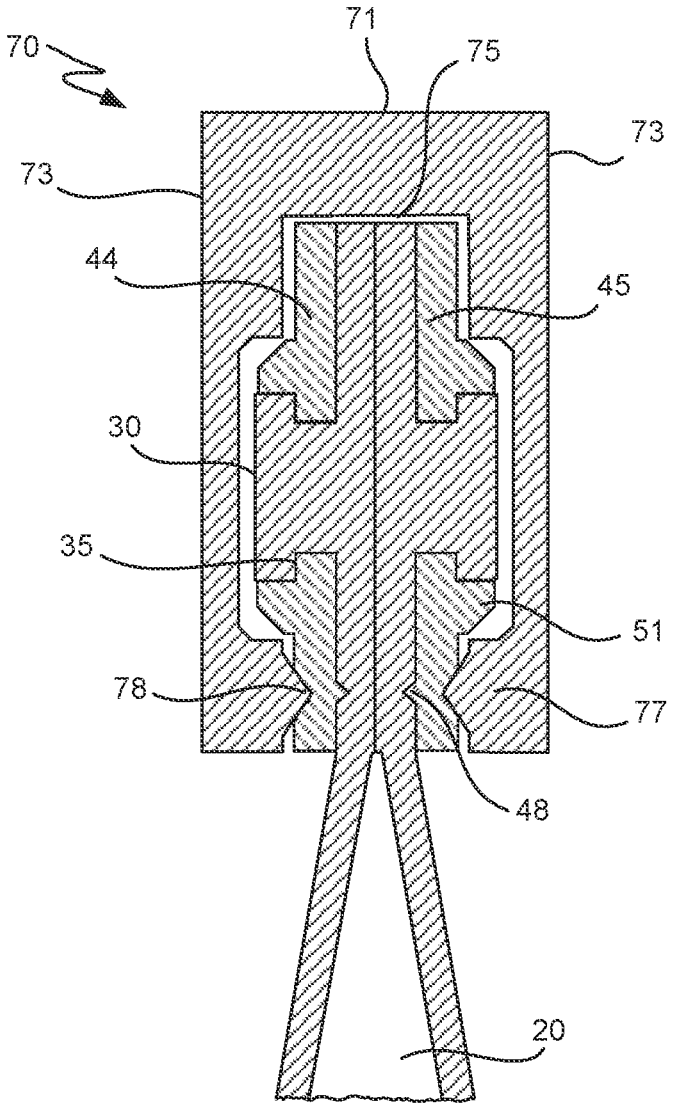
FIG. 10 is a cross sectional view of the upper portion of the sealable pouch assembly of FIG. 1, highlighting some of the internal features of the frame and slider.

The frame 40 is preferably a bi-stable hinge that has two distinct positions, open and closed. The closed position is shown in FIG. 6, an example of an open position is shown in FIG. 3. In the illustrated embodiment, the frame 40 has a pair of opposing rails 44, 45, hinges 47 and one or more ridge line(s) 48 on its internal surface (a single ridge line 48 per rail is shown in FIG. 10). The opposing ends of rails 44, 45 are joined together by the hinges 47. Each rail 44, 45 has one or more intermediate flexures 49 and a one or more of attachment openings 50. Each attachment opening 50 is configured to receive one of the pouch bosses 30 and serve as attachment points between the frame 40 and the pouch 20. That is, each boss 30 is inserted through an associated attachment opening 50 such that the lip portion 35 overhangs the frame 40, thereby securing the frame 40 to the pouch at each of the bosses 30. Since the pouch 20 is formed from a flexible/resilient material such as silicone, the boss heads 32 may be readily inserted through the openings to couple the pouch 20 to the frame 40, and withdrawn through the openings to separate the frame if/when desired. In the illustrated embodiment, the rails have raised berms 51 that each surround an associated one of the openings and define well 52 that receives a corresponding boss 30 as best seen in FIGS. 6, 8 and 10. The ridge line(s) 48 press into the adjacent portion of elastomeric pouch 20, or a groove therein, to help seal the pouch. In various embodiments, the ridge lines may be curved, angular, or otherwise shaped, may be formed on one or both of the rails 44, 45.

In the illustrated embodiment, each rail 44, 45 has a pair of intermediate flexures 49 and three openings 50. The intermediate flexures effectively divide each rail into three segments so that in the open state, the frame 40 has a substantially hexagonal shape (e.g., a rounded hexagonal shape) with an opening 50 on each rail segment. Thus, when the pouch 30 is secured to the frame 40, the pouch is attached to the frame on each rail segment. In the closed state, the rails 44, 45 are substantially parallel. However, more, or fewer attachment points (e.g., bosses 30) and corresponding rail segments may be provided to thereby alter the "open" state geometry of the pouch. The flexibility of the various flexures can also be varied to further manage the geometry of the open pouch.

Figure 7A:
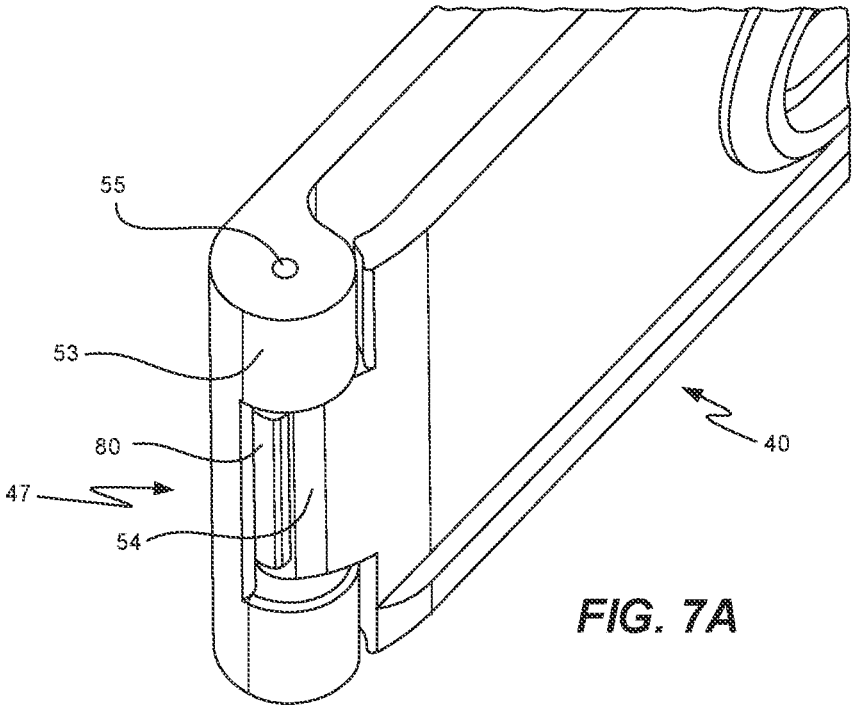
FIG. 7A is a perspective view highlighting a hinge region of the frame of FIG. 6.

The hinges 47 may be formed in a number of different ways. In some embodiments, each end of each rail includes one or more hinge knuckles 53, 54 and hinge pins 55 are provided to join the rail ends together as seen in FIG. 7A. In other embodiments, the rails may have molded pin and socket features that serve as the hinge 47. In still other embodiments, the hinge 47 may be a living hinge or flexure which is beneficial because it allows the frame 40 to be formed/molded as a single piece. Generally, the hinge is a bi-stable hinge that will rest in two different positions. In some embodiments this may be accomplished by creating a detent with two resting points—open and closed. The bi-stability can be accomplished using cam lobes or the like. If desired, the hinge can have more than two states, although such an arrangement is not desired for most applications.

Figure 7B:
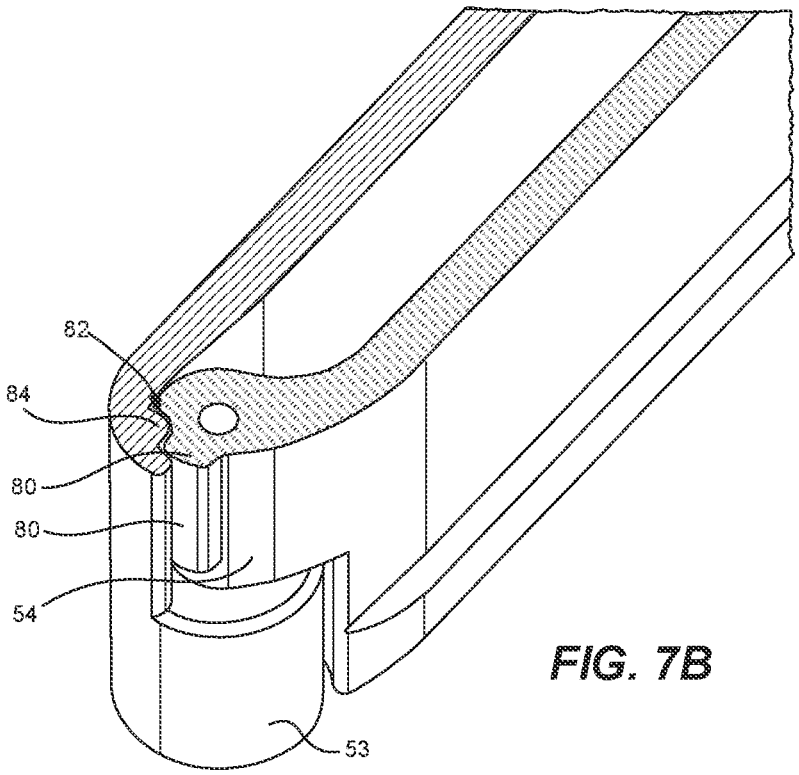
FIG. 7B is a cut-away perspective view of a bi-stable hinge embodiment in the "closed" position.
Figure 7C:
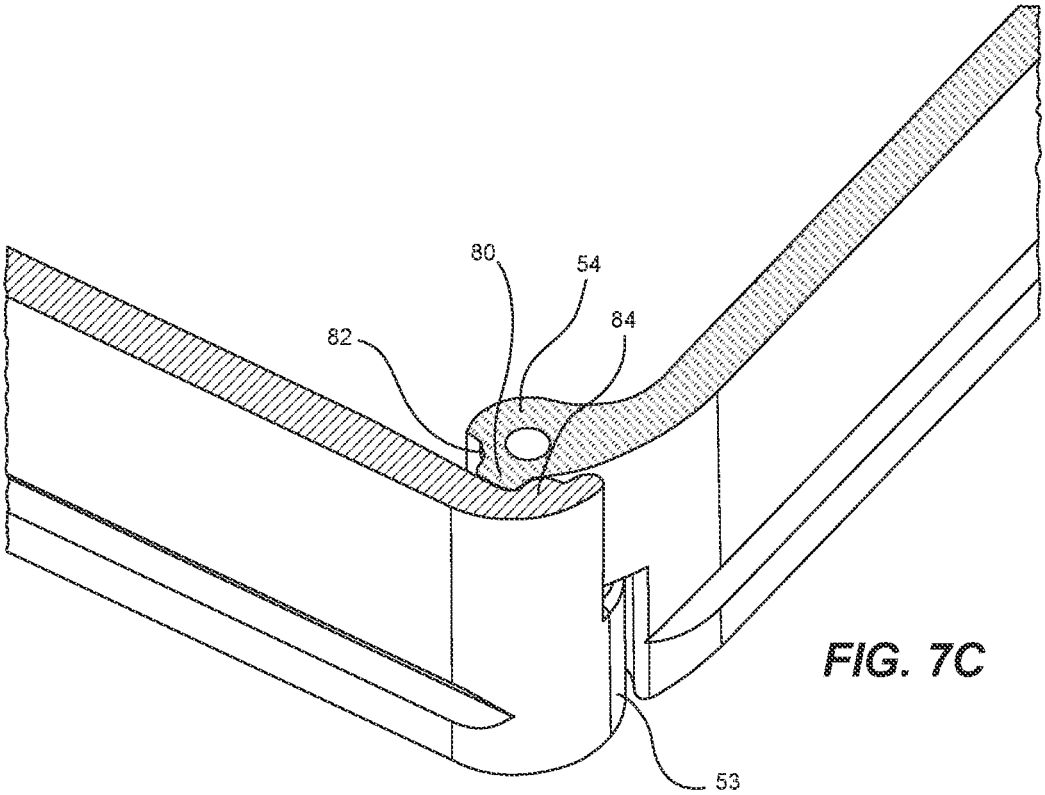
FIG. 7C is a cut-away perspective view of the bi-stable hinge embodiment in the "open" position.

FIGS. 7B and 7C are cut-away perspective views of a representative cam based bi-stable hinge 47. In the illustrated embodiment, knuckle 54 includes a cam 80 and a trough 82. The portion of the rail between opposing knuckles 53 includes an elongated, vertically extending rib 84 that is complementary to trough 82. In the closed position, the rib 84 is aligned with and fits into the trough 82 as best seen in FIG. 7B. such that interference between the cam 80 and the rib 84 helps hold the frame 40 in the closed position. Since the frame 40 is made from a material that has some flexibility, when force is applied to open the frame/pouch, the cam 80 will rotate over the rib 84 to the stable "open" position shown in FIG. 7C. The resilience of the frame rails will bias the frame towards the closed position, however the interference between the cam 80 and rib 84 is strong enough to keep the frame from returning to the closed position on its own—thus providing the bi-stable open frame position shown in FIGS. 3 and 7C.

In the embodiment illustrated in FIG. 8, the intermediate flexures 49 are provided by relief (scored or debossed) channels/grooves 58. However, in other embodiments, other types of flexures may be used, as for example a thinned wall segment. Thinning the frame rail wall (through its thickness and/or its height) can create an area of material that is readily flexed. The number of thinned area and their respective geometries (depth, height, etc.) can be varied to adjust the amount and shape of the flexing area.

The frame may be formed from a variety of materials. By way of example, food-safe semi-rigid plastics such as polypropylene work well. Other plastics that can be used to form the frame include Nylons, Acrylonitrile butadiene styrene (ABS), polycarbonate and others. In other embodiments, the frame may be formed from a flexible metal or other suitable materials. The frames may be formed using a variety of conventional techniques. By way of example, injection molding works well when plastics (e.g. polypropylene) are used.

In the embodiments described above, the pouch 20 and frame 40 are formed as separate pieces that are coupled together after fabrication. However, in alternative embodiments, the frame may be molded directly onto the pouch using an overmolding process.

Figure 9:
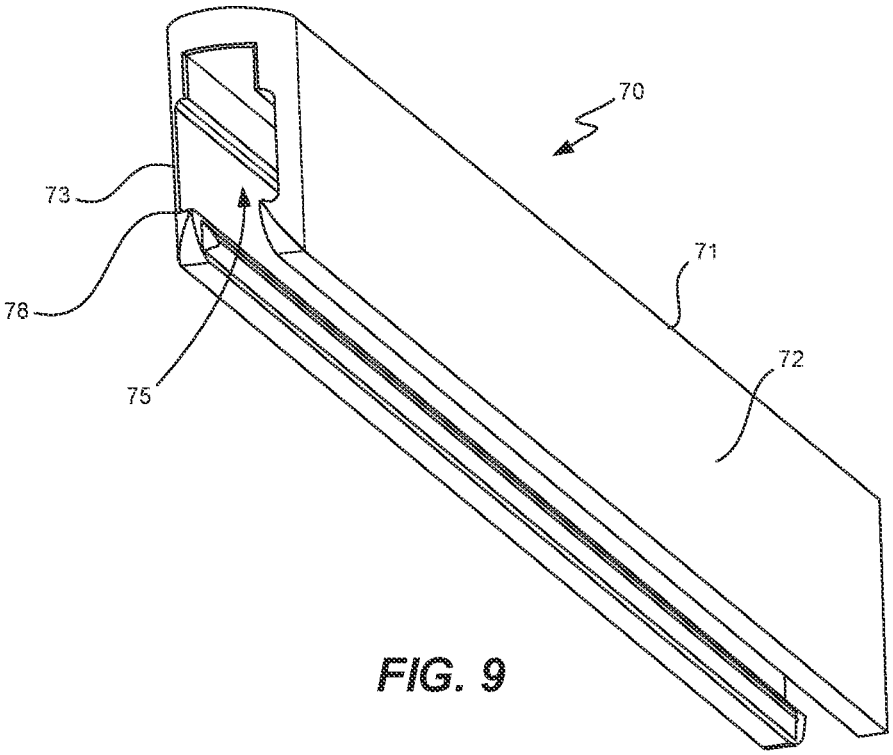
FIG. 9 is a perspective view of a slider suitable for use in the sealable pouch assembly of FIG. 1.

When pouch assembly 10 is assembled, the pouch may be sealed in a variety of different manners. In the embodiment of FIGS. 1-3, a slider 70 is provided. The slider 70 is configured to slide over the frame 40 when the frame is in the closed position as best seen in FIG. 1. The slider 70 includes a top wall 71 and side walls 72, 73 that together define an internal channel 75 as best seen in FIGS. 9 and 10. The channel 75 is sized to receive the frame 40 and the top end of the pouch 20 there through. Inward extending flanges 77 at the bottom (distal) end of the side walls form internal ledges that cooperate with the side walls to closely receive and constrain the frame 40. The side walls 72, 73 are appreciably rigid so that they press against the frame 40 when slid there-over. The frame, in turn presses the panels 22, 24 of pouch 20 together. When the pouch 20 is formed from a soft, resilient material such as silicone, this pressing of the pouch panels together forms a good watertight seal. In some embodiments, the inner surfaces of the rails may be flat. In other embodiments, one or more longitudinally extending pressure ridges 48 is/are formed on the inner surface of one or both of the rails 44, 45 as seen in FIG. 10. The ridge further deforms the elastomeric pouch to further enhance the sealing function. In another embodiment, one or more longitudinally extending pressure ridge(s) 78 is/are formed on one or both of the interior faces of the slider 70. Such ridge(s) may be laterally adjacent to the pressure ridge 48 formed on the rail. In some embodiments, the pressure ridge 48 extends into a complementary groove in the exterior surface of the adjacent rail when the slider is installed. In yet another embodiment, one or more ridges (not shown), which may be formed on one or both sealing faces of the pouch 20 (i.e., the internal faces of the pouch that contact one another in the vicinity of the frame 40 when the pouch is in the closed position. The various ridges may take any suitable shape including curved, angular, or otherwise lateral shapes.

Figure 11:
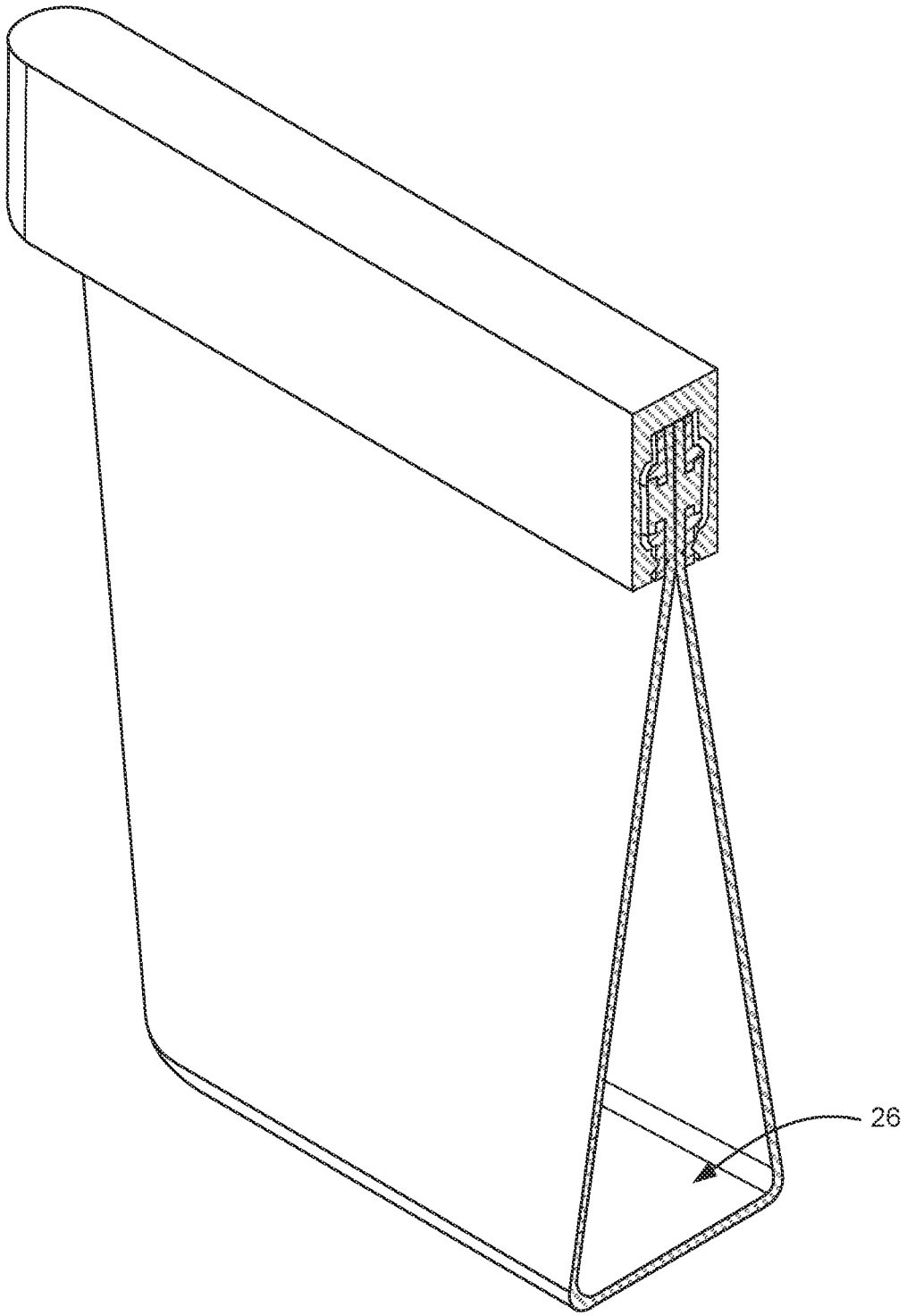
FIG. 11 is a cut-away perspective view of the assembled sealable pouch assembly of FIG. 1.

FIG. 11 is a cut-away perspective view of the pouch 20 with the slider 70 positioned over the frame 40. In this view the gusset 26 can be readily seen.

In some embodiments, the frame may include a detent feature and the slider a corresponding nub or protrusion that engages the detent (or vice versa) to define a "home" position for the slider when the slider is mounted on the pouch. This can be designed to have the slider "click" into position. Alternatively, the berms 51 of one or more of the wells 52 or the head portions 32 of one or more of the bosses 30 may be used for such purposes.

In the illustrated embodiment, the slider is untethered. However, in other embodiments the slider may be tethered to either rail or the pouch itself by a cord or rubber piece.

Although only a few embodiments of the invention have been described in detail, it should be appreciated that the invention may be implemented in many other forms without departing from the spirit or scope of the invention. Therefore, the present embodiments should be considered illustrative and not restrictive and the invention is not to be limited to the details given herein, but may be modified within the scope and equivalents of the invention.

What is claimed is:

1. A sealable pouch assembly comprising:

a soft pouch formed from an elastomeric material, the pouch including a plurality of spaced apart external protrusions located near a top end of the pouch, the protrusions being integrally formed with the soft pouch from the elastomeric material and each including an overhanging portion;

a semi-rigid external frame having a stable closed state and a stable open state, the external frame including a plurality of openings, each opening being configured to receive a corresponding one of the pouch protrusions with the overhanging portion of the protrusions gripping the external frame to attach the frame to the pouch; and a slider configured to slide over the external frame with the external frame in the closed state to seal the pouch in a closed pouch state.

2. A sealable pouch assembly as recited in claim 1 wherein the external frame openings are laterally elongated and the pouch protrusions are laterally elongated, each laterally elongated opening being configured to receive the corresponding laterally elongated pouch protrusion; and the overhanging portions of the protrusions are sufficiently flexible to allow the overhanging portions of the protrusions to be inserted and withdrawn through the corresponding frame openings to facilitate attaching and detaching the pouch from the external frame.

3. A sealable pouch assembly as recited in claim 2 wherein the frame openings take the form of stepped wells that receive the protrusions.

4. A sealable pouch assembly as recited in claim 1 wherein the external frame includes a pair of unitary rails and a pair of hinges, wherein a first one of the hinges couples first ends of the rails together and a second one of the hinges couples second ends of the rails together.

5. A sealable pouch assembly as recited in claim 4 wherein each rail further includes a pair of intermediate flexures such that the open state of the external frame has a substantially hexagonal shape.

6. A sealable pouch assembly as recited in claim 5 wherein each flexure includes at least one channel.

7. A sealable pouch assembly as recited in claim 4 wherein:

each hinge includes a hinge pin, at least one first knuckle integrally formed with a first one of the rails and at least one second knuckle integrally formed with a second one of the rails, and at least one of the rails includes a feature that interferes with one of the knuckles on the other rail to help provide the stable open and closed states.

8. A sealable pouch assembly as recited in claim 1 wherein the external frame is a bi-stable external frame.

9. A sealable pouch assembly as recited in claim 1 wherein the frame is formed from a material selected from the group consisting of:

polypropylene;

Nylon;

acrylonitrile butadiene styrene (ABS); and polycarbonate.

10. A sealable pouch assembly as recited in claim 1 wherein the frame is formed by injecting molding.

11. A sealable pouch assembly as recited in claim 1 wherein the frame is molded directly onto the pouch.

12. A sealable pouch assembly as recited in claim 1 wherein the pouch includes a gusset that facilitates standing the pouch upright.

13. A sealable pouch assembly as recited in claim 1 wherein the pouch is formed from a material selected from the group consisting of:

silicone;

an elastomeric plastic;

a thermoplastic rubber; or a thermoplastic elastomer.

14. A sealable pouch assembly as recited in claim 1 wherein at least one of the rails includes a longitudinally extending pressure ridge on an inner surface of the rail that helps seal the pouch in the closed pouch state with the slider in place.

15. A sealable pouch assembly as recited in claim 1 wherein the frame is formed from a polymeric material.

16. A sealable pouch assembly comprising:

a soft pouch formed from an elastomeric material, the pouch including a plurality of spaced apart external protrusions located near a top end of the pouch;

a semi-rigid external frame having a stable closed state and a stable open state, the external frame including a plurality of rails attached to the pouch by the protrusions;

a knuckle on a first one of the rails includes a cam and a second one of the rails has a feature that interferes with the knuckle to help provide the stable open and closed states, and a slider configured to slide over the external frame with the external frame in the closed state to seal the pouch in a closed pouch state.

17. A sealable pouch assembly as recited in claim 16, wherein the protrusions are flexible mushroom shaped bosses having overhanging portions configured to grip the external frame to attach the frame to the pouch, the overhanging portions of the mushroom shaped bosses being sufficiently flexible to allow the overhanging portions of the mushroom shaped bosses to be inserted and withdrawn through corresponding openings in the frame to facilitate attaching and detaching the pouch from the external frame.

18. A sealable pouch assembly as recited in claim 16 wherein:

the sealable pouch assembly further comprises a first hinge that couples first ends of the rails together;

the knuckle is part of the first hinge and is integrally formed with the first rail; and the interfering feature is integrally formed with the second rail.

19. A sealable pouch assembly as recited in claim 16 wherein:

the plurality of rails consists of the first and second rails;

the sealable pouch assembly further comprises a pair of hinges, a first one of the hinges coupling first ends of the rails together and a second one of the hinges coupling second ends of the rails together; and the knuckle is part of the first hinge and is integrally formed with the first rail.

20. A sealable pouch assembly as recited in claim 19 wherein:

each rail further includes a pair of intermediate flexures such that the open state of the external frame has a substantially hexagonal shape;

the external frame is a bi-stable external frame; and at least one of the rails includes a longitudinally extending pressure ridge on an inner surface of the rail that helps seal the pouch in the closed pouch state with the slider in place.

21. A sealable pouch assembly as recited in claim 16 further comprising a plurality of hinges, each hinge coupling an adjacent pair of the rails together, each hinge including a hinge pin, at least one first knuckle integrally formed with a first one of the adjacent rails and at least one second knuckle integrally formed with a second one of the adjacent rails, and at least one of the adjacent rails includes a feature that interferes with one of the at least one knuckles on the other adjacent rail to help provide the stable open and closed states.

22. A sealable pouch assembly comprising:

a soft pouch formed from an elastomeric material, the pouch including a plurality of integrally formed, spaced apart, elastomeric external protrusions located near a top end of the pouch;

a bi-stable semi-rigid external frame having a stable closed state and a stable, substantially hexagonal, open state, and including a pair of rails and a pair of hinges, each rail including a plurality of openings and a pair of intermediate flexures, each opening being configured to receive a corresponding pouch protrusion to facilitate attaching the pouch to the external frame, and wherein a first one of the hinges couples first ends of the rails together and a second one of the hinges couples second ends of the rails together, and wherein each protrusion includes overhangs configured to grip the external frame; and a slider configured to slide over the external frame with the external frame in the closed state to seal the pouch in a closed pouch state.

23. A sealable pouch assembly as recited in claim 22 wherein:

the pouch is formed from silicone and includes a gusset that facilitates standing the pouch upright; and the frame is formed from a polymeric material.

* * * * *